US006334265B1

(12) United States Patent
Emmel et al.

(10) Patent No.: US 6,334,265 B1
(45) Date of Patent: Jan. 1, 2002

(54) PROCESS FOR THE OPERATION OF A REGENERATOR AND REGENERATOR

(75) Inventors: Andres Emmel, Hahnbach; Dragan Stevanovic; Hans-Georg Fassbinder, both of Sulzbach-Rosenberg, all of (DE)

(73) Assignee: Applikations-und Technikzentrum fur Energieverfahrens-Umwelt und Stromungstechnik, Sulzbach-Rosenberg (DE)

( * ) Notice: Subject to any disclaimer, the term of this patent is extended or adjusted under 35 U.S.C. 154(b) by 0 days.

(21) Appl. No.: 09/578,201

(22) Filed: May 24, 2000

Related U.S. Application Data

(62) Division of application No. 09/167,017, filed on Oct. 6, 1998, now Pat. No. 6,092,300.

(30) Foreign Application Priority Data

Oct. 8, 1997 (DE) ..... 197 44 387

(51) Int. Cl.[7] ..... F26B 3/14
(52) U.S. Cl. ..... 34/332; 34/345; 34/473
(58) Field of Search ..... 34/330, 332, 333, 34/345, 472, 473

(56) References Cited

U.S. PATENT DOCUMENTS

| | | | | | |
|---|---|---|---|---|---|
| 2,458,358 | A | * | 1/1949 | Evans | 252/418 |
| 2,458,434 | A | * | 1/1949 | Simpson | 252/418 |
| 3,559,296 | A | * | 2/1971 | Dratwa et al. | 34/9 |
| 4,220,196 | A | * | 9/1980 | Gawron et al. | 165/11 R |
| 5,577,553 | A | * | 11/1996 | Fassbinder | 165/10 |

* cited by examiner

*Primary Examiner*—Corrine McDermott
*Assistant Examiner*—Malik N. Drake
(74) *Attorney, Agent, or Firm*—Pearne & Gordon LLP

(57) ABSTRACT

The invention relates to a process for the operation of a regenerator, hot and cold gas being repeatedly passed through a bulk material 4 with a maximum particle diameter $D_{max}$ which is received in the annular space 1 between a substantially cylindrical hot grid 3 and a cold grid 4 surrounding the latter, and at least one discharge opening 16 being provided in the bottom B of the annular space 1 for discharging the bulk material 4. To increase the service life of the regenerator, it is proposed according to the invention that a predetermined amount of bulk material 4 is discharged during or after the passing-through of hot gas, so that a compressive stress exerted by the bulk material 4 on the hot grid 3 and cold grid 4 is reduced.

5 Claims, 7 Drawing Sheets

PROCESS FOR THE OPERATION OF A REGENERATOR AND REGENERATOR

Figure 1:
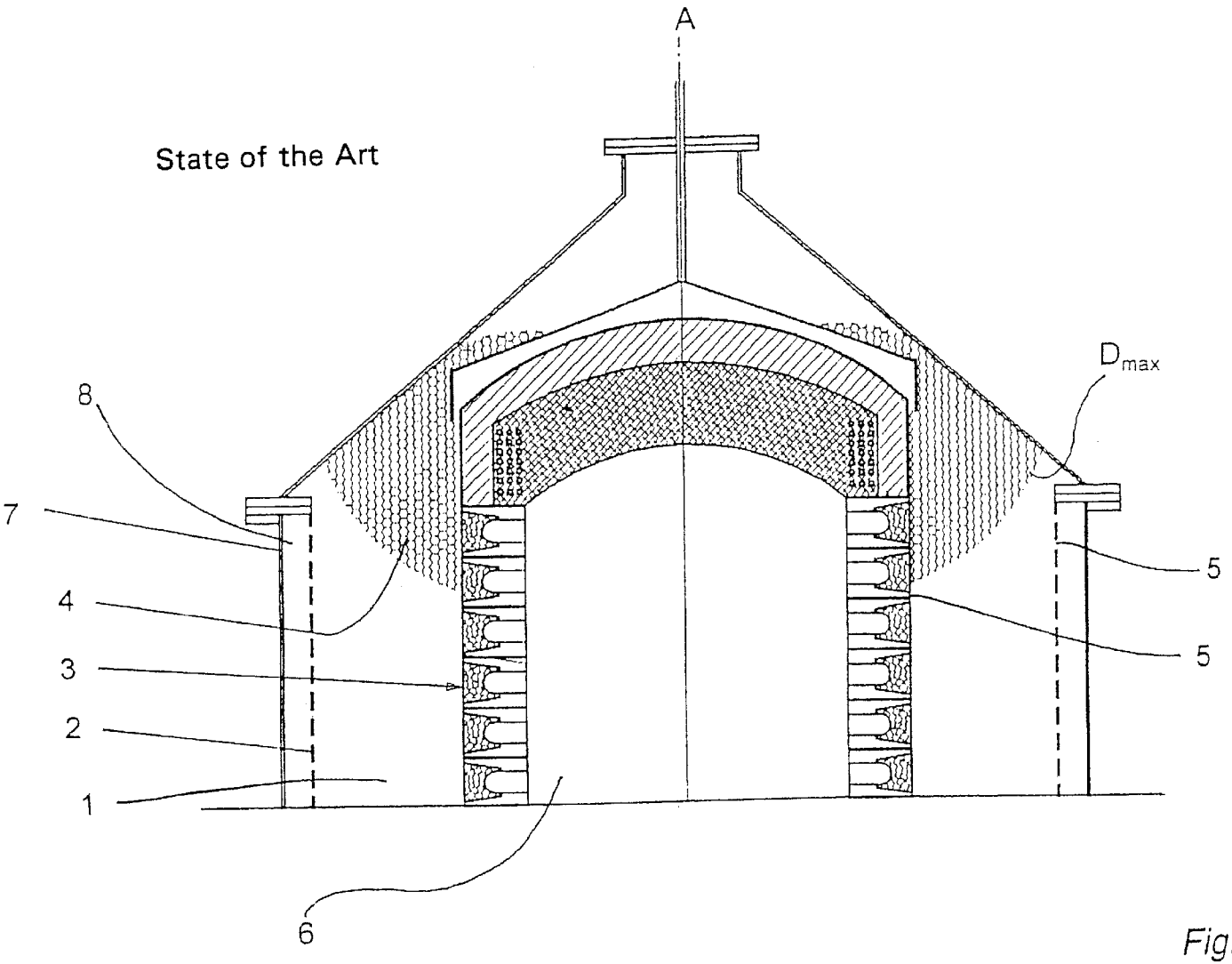

This is a divisional of application Ser. No. 09/167,017, filed Oct. 6, 1998 now U.S. Pat. No. 6,092,300.

The invention relates to process for the operation of a bulk-material regenerator or regenerator according to the preamble of claim 1. It also relates to a regenerator according to the preamble of claim 6.

Such regenerators are used for heating gases to temperatures of customarily 800° C. In the operation of blast furnaces, for example, regenerators serve for generating a hot blast of air at a temperature of 1200° C. Such regenerators are known, for example, from U.S. Pat. No. 2,272,108, DE 41 08 744 C1 or DE 42 38 652 C1.

In the case of the known regenerators, a bulk material is received in an annular space between an inner cylindrically designed so-called hot grid and a so-called cold grid coaxially surrounding the latter. Both the hot grid and the cold grid are provided with apertures or openings, the diameter of which is chosen such that a passing-through of gas is possible, but a passing-through of bulk material is impossible. In practice, the cold grid is customarily produced from a perforated metal plate and the hot grid is customarily produced from ceramic materials, for example from fireclay bricks. Gravel or aluminum oxide beads are used, for example, as bulk material.

In the case of the known apparatus, the hot grid and/or cold grid disadvantageously ruptures after only short operating times or service lives. The replacement of a ruptured hot grid and/or cold grid is very costly.

The object of the invention is to specify a process for the operation of a regenerator and a regenerator which ensure an improved service life.

This object is achieved by the features of claims 1 and 6. Expedient refinements emerge from the features of claims 2 to 5 and 7 to 18.

According to what is specified by the invention with respect to the process, it is provided that a predetermined amount of bulk material is discharged during or after the passing-through of hot gas, so that a compressive stress exerted by the bulk material on the hot grid or cold grid is reduced.—The service life of the regenerator is drastically prolonged as a result.

The discharged bulk material is advantageously fed back into the annular space. As a result, the required minimum filling level of bulk material is maintained. If bulk material of high value is used, the reuse may have the effect of reducing operating costs.

The discharged bulk material may be transported pneumatically, it advantageously being fed to the annular space through a feed opening provided in the vicinity of its top. In this case, a transporting gas can be separated from the bulk material and be blown off into the surroundings. The aforementioned features make it possible for the process to be automated.

According to what is specified by the invention with respect to the regenerator, it is provided that the hot grid and/or cold grid is/are designed such that the bulk material can freely expand radially during heating up.—Consequently, the effect of thermally induced compressive stresses of the bulk material on the hot grid and/or cold grid is reduced. A rupture of the hot grid and/or cold grid is avoided. The service life of the regenerator is prolonged.

According to one refining feature, the hot grid and/or cold grid is provided with at least one opening, the diameter of which is greater than the maximum particle diameter, so that compressive stress formed in the bulk material can be compensated by a proportion of the bulk material passing through the opening. A device for catching bulk material emerging from the opening is expediently provided on the side of the opening facing away from the annular space.

According to a further refining feature, the device for catching has at least one sloping surface running obliquely with respect to the axis of the regenerator, the sloping surface running from the outer side of the hot grid or cold grid, facing away from the annular space, to an inner side, facing toward the annular space, and declining in the direction of the bottom of the annular space.

Furthermore, the apparatus may be closable by means of a cover provided with apertures, the apertures being formed such that a passing-through of gas is possible, but a passing-through of bulk material is impossible. An entrainment of individual particles of bulk material by the emerging stream of gas is avoided as a result.

According to a further refinement, at least one discharge opening is provided in the bottom of the annular space. Discharging bulk material during or after heating up likewise makes it possible to reduce compressive stresses exerted by the bulk material on the hot grid and/or cold grid.

The discharge opening expediently opens into a tube, it being possible to provide a means for closing the tube. The tube advantageously opens into a transporting tube. A device for generating a stream of transporting gas may be connected to the transporting tube, so that the bulk material can be transported pneumatically through the transporting tube. The aforementioned features make possible an automated return of discharged bulk material into the annular space.

The transporting tube may be in connection with a feed opening provided in the vicinity of the top of the annular space. A device for separating the bulk material from the transporting gas is advantageously provided on the side of the feed opening facing away from the annular space. Cooling down in the region of the annular space is avoided as a result.

Figure 3:
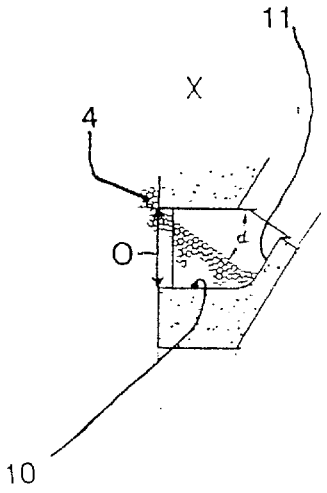
Figure 2:
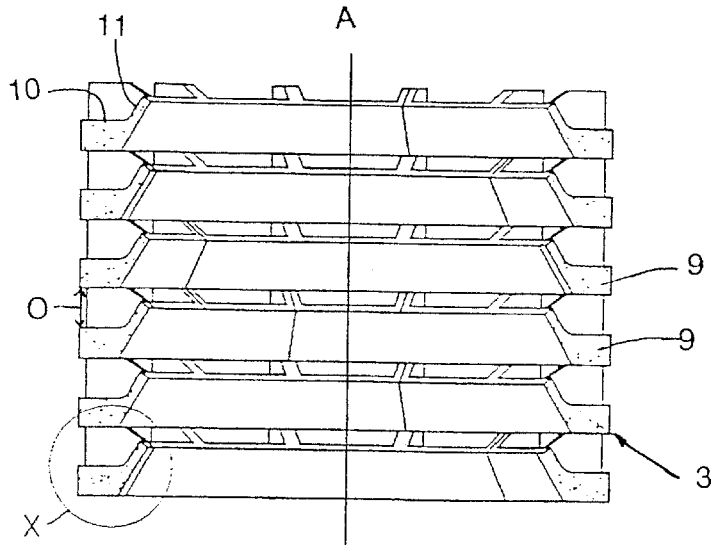
Figure 4:
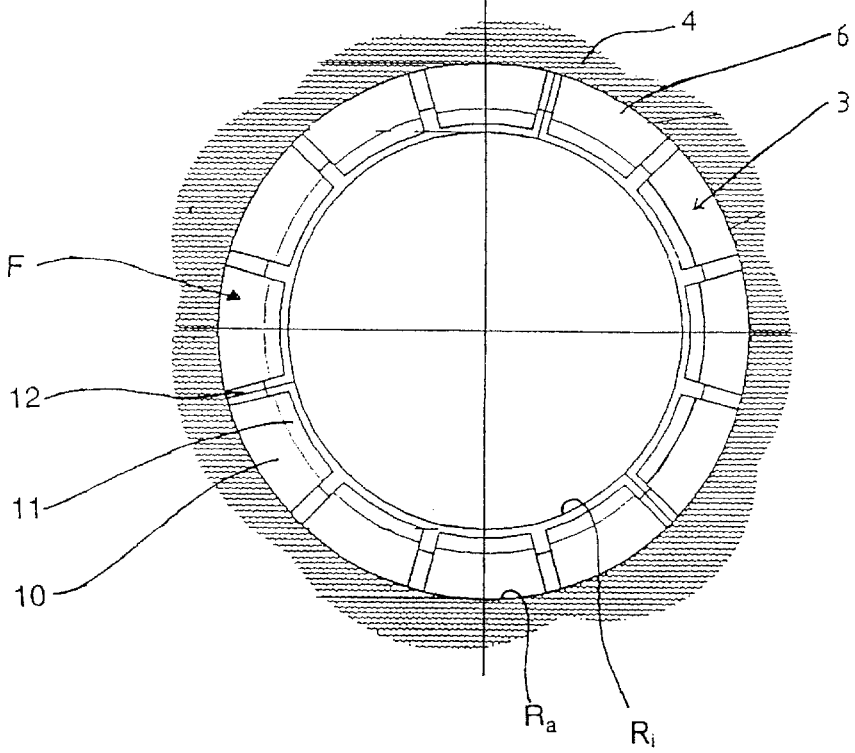
Figure 5B:
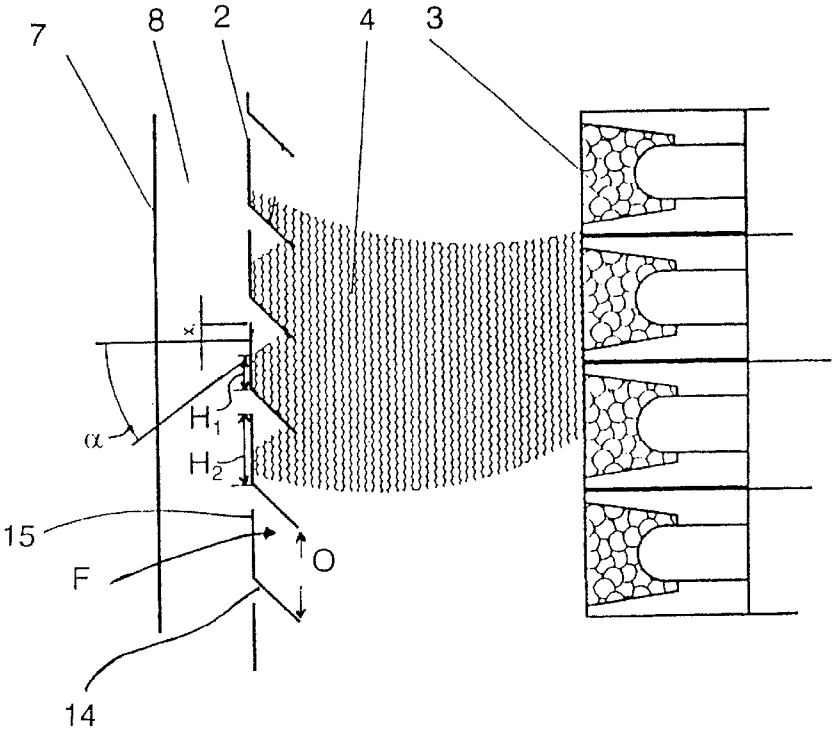
Figure 5A:
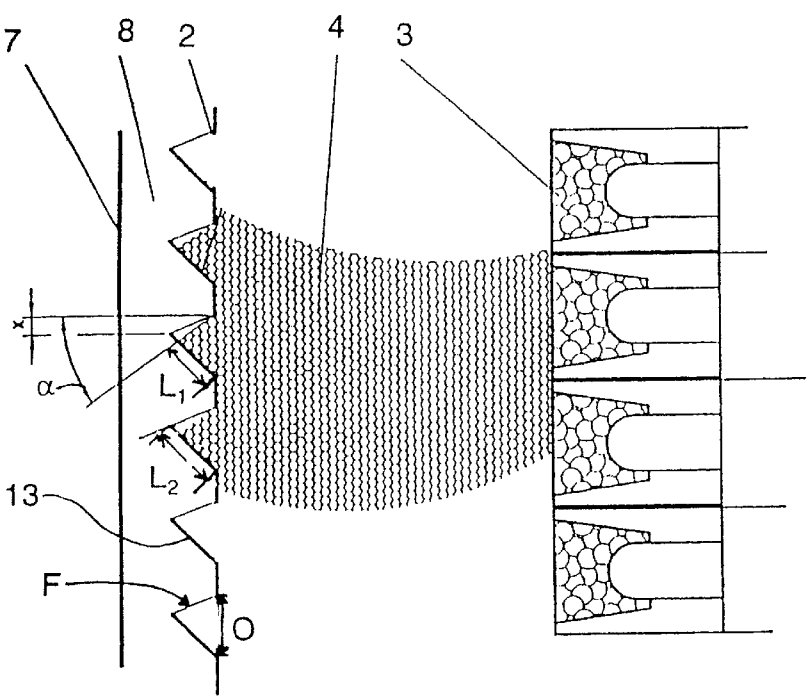
Figure 6:
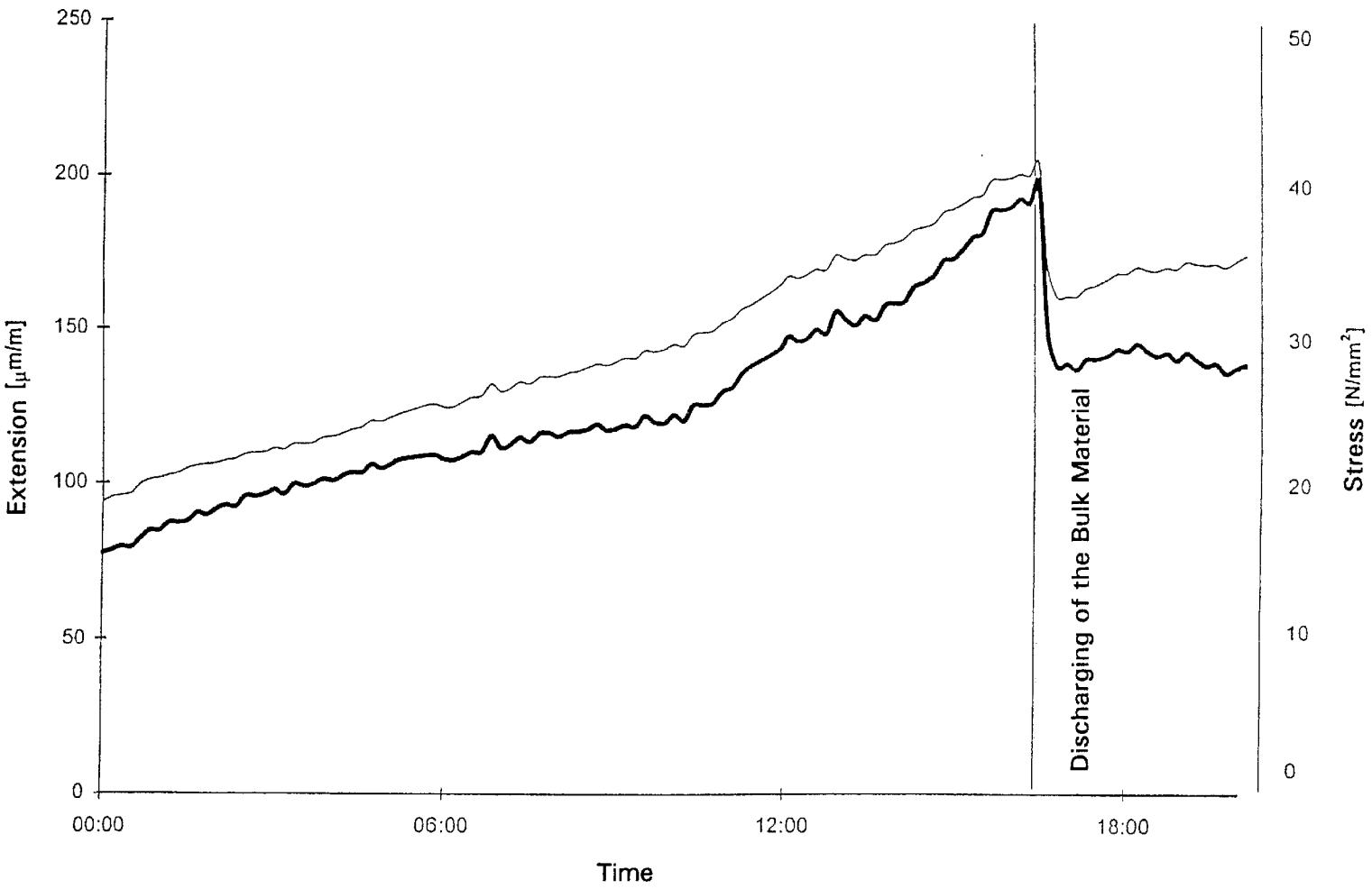
Figure 7:
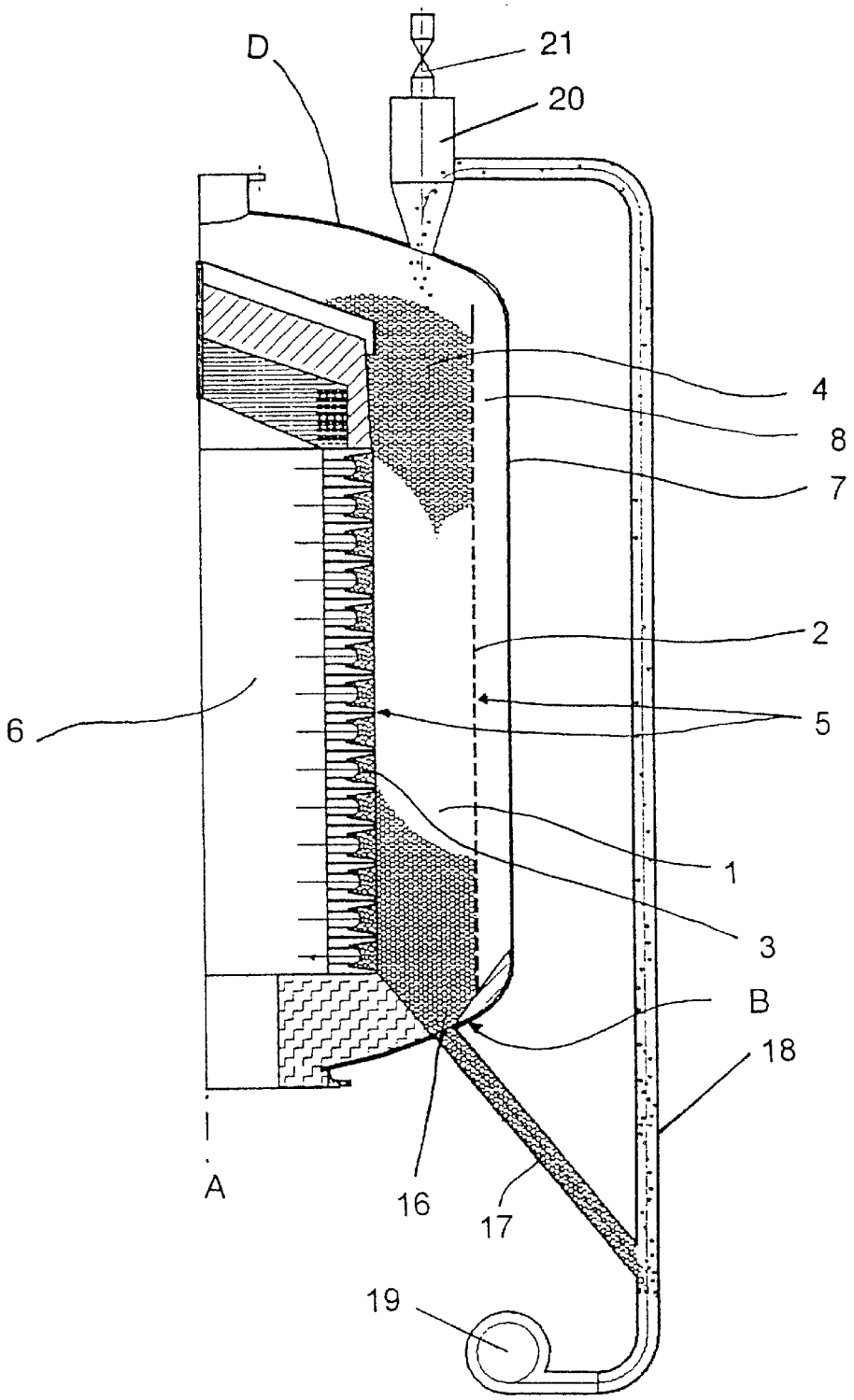
Figure 8B:
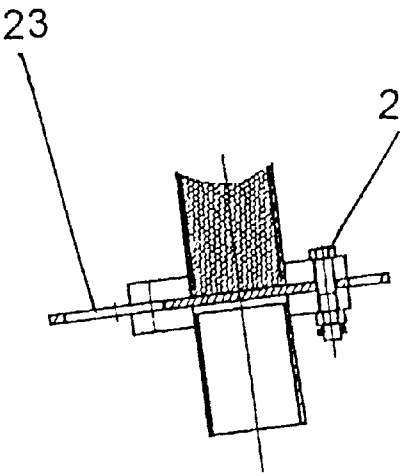
Figure 8C:
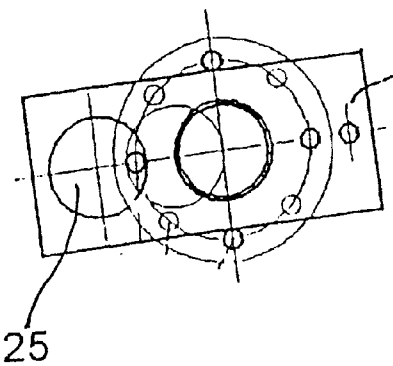
Figure 8A:
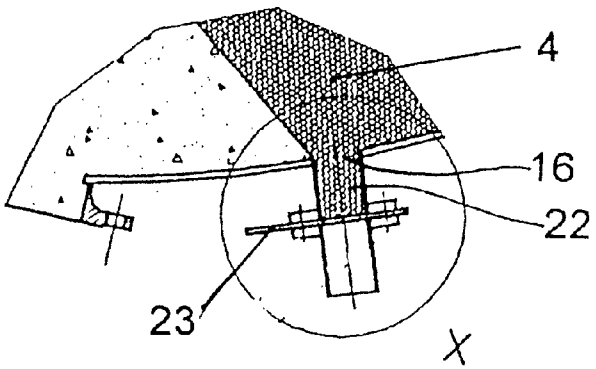
Figure 9C:
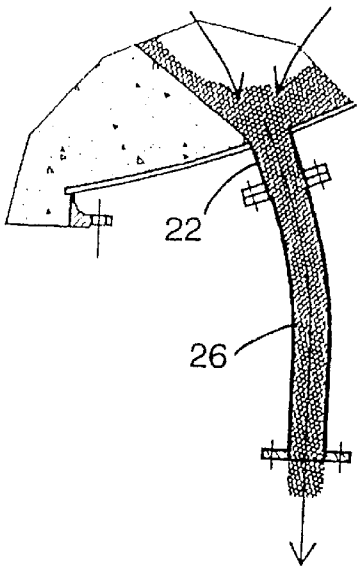
Figure 9B:
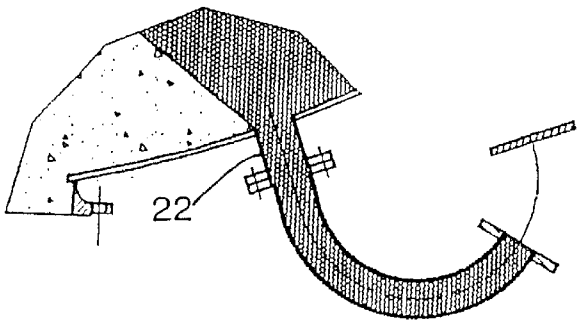
Figure 9A:
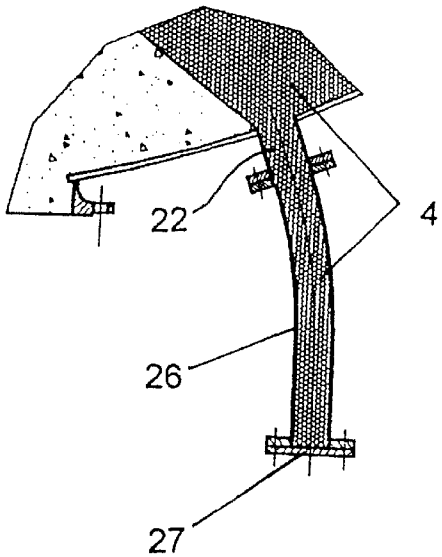

Exemplary embodiments of the invention are explained in more detail below with reference to the drawing, in which:

FIG. 1 shows a cross-sectional view of a regenerator according to the prior art, FIG. 2 shows a cross-sectional view through a first exemplary embodiment, FIG. 3 shows a partial cross-sectional view according to FIG. 2, FIG. 4 shows a plan view according to FIG. 2, FIG. 5*a* shows a cross-sectional view of a second exemplary embodiment, FIG. 5*b* shows a cross-sectional view of a third exemplary embodiment, FIG. 6 shows the variation in stress at the cold grid when discharging bulk material, FIG. 7 shows a partial cross-sectional view of a fourth exemplary embodiment, FIG. 8*a* shows a cross-sectional view of a first discharge, FIG. 8*b* shows an enlarged representation according to FIG. 8*a*, FIG. 8*c* shows a plan view according to FIG. 8*b*, FIG. 9*a* shows a cross-sectional view of a second discharge, FIG. 9*b* shows a cross-sectional view of a third discharge, FIG. 9*c* shows a cross-sectional view of a fourth discharge.

In FIG. 1, a regenerator according to the prior art is shown in cross section. An axis of the regenerator is denoted by A. Bulk material 4 (only partially shown here), with a maximum particle diameter $D_{max}$, is received in the annular space 1 between a cylindrically designed cold grid 2 and a hot grid 3 arranged coaxially with respect to the latter. The cold grid 2 and the hot grid 3 have gas passages 5. The maximum diameter of the gas passages 5 is chosen such that a passing-through of bulk material 4 is not possible. 6 denotes a hot collecting space or hot space surrounded by the hot grid 3 and 7 denotes a wall surrounding the cold grid 2. Between the wall 7 and the cold grid 2 there is a cold collecting space or cold space 8.

A first exemplary embodiment, namely a hot grid 3, is shown in FIGS. 2 to 4. The hot grid 3 comprises a plurality of ring segments 9 arranged one above the other and produced for example from fireclay bricks. Respective pairs of ring segments 9 lying one above the other form a plurality of openings O facing toward the bulk material 4. It goes without saying that polygonally designed segments may also be used instead of ring segments.

FIG. 3 shows an enlarged cross-sectional view according to the region denoted by X in FIG. 2. Bulk material 4 passing through the opening O rests substantially on a planar surface 10, which is bounded by a first sloping surface 11. The first sloping surface 11 is directed obliquely with respect to the axis A. It declines from an outer side of the hot grid 3, facing away from the bulk material 4, to an inner side, facing toward the bulk material 4. Respective pairs of supporting webs 12, extending radially from an inner radius $R_i$ to an outer radius $R_a$, form together with the planar surface 10 and the first sloping surface 11 a compartment F.

FIG. 5*a* shows a second exemplary embodiment, namely a cold grid 2. Provided behind the openings O on the side facing away from the bulk material 4 are compartments F, which are radially bounded by second sloping surfaces 13. The bulk material 4 passes through the opening O, forming an angle of repose $\alpha$ typical of the type of bulk material, and rests with a first length $L_1$ on the second sloping surface 13. A second length $L_2$ of the second sloping surface 13 is greater than the first length $L_1$.

In FIG. 5*b*, the compartment F is bounded radially by a third sloping surface 14 and a vertical surface 15. When the angle of repose $\alpha$ is formed, the bulk material 4 is against the vertical surface 5 with a first height $H_1$. A second height $H_2$ of the vertical surface 15 is greater than the first height $H_1$.

In FIG. 6, the expansion of the cold grid and the stress occurring at it are shown as a function of the operating time. It can be clearly seen that a removal of bulk material brings about a considerable reduction in the stress and the expansion. This effect is used in the following exemplary embodiments.

In FIG. 7, a cross-sectional view of a fourth exemplary embodiment is shown. On the bottom B of an annular space 1 there is a discharge opening 16, which is connected via a tube 17 to a transporting tube 18. A blower 19 fitted at the end of the transporting tube 18 serves for generating a stream of transporting gas. Fitted in the vicinity of a top D of the annular space 1 is a cyclone 20, the conically tapered opening of which opens into the annular space 1. The cyclone 20 is provided with a discharge valve 21.

FIGS. 8*a* to 8*c* show a first outlet in cross section and in plan view. The outlet opening 16 opens into a tube connecting piece 22. The tube connecting piece 22 is closed by a slide 23, the slide 23 being secured in the closure position by means of at least one bolt 24. In the open position, a slide aperture 25 is in line with the tube connecting piece 22.

In FIGS. 9*a* to 9*c*, there is flange-mounted onto the tube connecting piece 22 a discharge tube 26, which can assume different curvatures.

The discharge tube 26 may be formed, for example, as a flexible metal tube and be provided with a closure 27.

The regenerator operates as follows:

Hot gas passes into the hot space 6. From there, it passes through the bulk material 4, received between the hot grid 3 and the cold grid 2, and passes,into the cold space 8. When the bulk material 4 is passing through, a large part of the heat of the hot gas is transferred to the bulk material 4. The bulk material 4 thus expands. This produces a radial compressive stress, which acts on the hot grid 3 and the cold grid 2. To compensate for the compressive stress, according to FIGS. 2 to 4 and FIGS. 5*a* and 5*b* the hot grid 3 and/or cold grid 2 may be provided with openings O, the diameter of which is greater than the maximum particle diameter $D_{max}$ of the bulk material 4. On the side of the opening O facing away from the bulk material 4 there is respectively provided a device which accumulates the bulk material 4 passing through. The accumulation takes place by forming the angle of repose $\alpha$ typical of the respective type of bulk material 4.

As soon as a radial compressive stress occurs in the bulk material 4, the bulk material 4 is pressed through the openings O to compensate for this; the compressive stresses are reduced as a result. The bulk material 4 pressed through the openings O subsequently closes the same automatically, again forming the angle of repose $\alpha$ typical of the type of bulk material. The velocity of the gas emerging through the openings O or compartments F is chosen such that no bulk material is dislodged from the surface areas of bulk material facing the hot space 6 or cold space 8 and is entrained with the stream of gas.

The radial compressive stresses occurring in the bulk material 4 may also be reduced, however, by a re-arrangement of the bulk material 4 directed toward the bottom B. As a result, a small amount of bulk material 4 is discharged through the outlet opening 16 during or after the passing of hot gas through the bulk material 4. It goes without saying that a plurality of outlet openings 16 may be provided.

The outlet openings 16 are expediently connected via tubes 17 to a common transporting tube 18. The discharged bulk material 4 passes into the transporting tube 18 and is blown by the action of the blower 19 to a cyclone 20. A separation of the transporting gas from the bulk material 4 takes place in the cyclone 20.

The bulk material 4 is fed to the annular space 1 again in the vicinity of the top D.

It goes without saying that the procedure described above of discharging and feeding back discharged bulk material 4 can be automated.

List of Designations

1 annular space
2 cold grid
3 hot grid
4 bulk material
5 gas passage
6 hot space
7 wall
8 cold space
9 ring segment
10 planar surface
11 first sloping surface
12 supporting web
13 second sloping surface
14 third sloping surface
15 vertical surface
16 discharge opening

17 tube
18 transporting tube
19 blower
20 cyclone
21 outlet valve
22 pipe connecting piece
23 slide
24 bolt
25 slide aperture
26 discharge tube
27 closure
$D_{max}$ maximum particle diameter
$\alpha$ angle of repose
A axis
B bottom
F compartment
$L_1$ first length
$L_2$ second length
$H_1$ first height
$H_2$ second height
O opening
$R_i$ inner radius
$R_a$ outer radius
D top

What is claimed is:

1. Process for the operation of a regenerator, hot and cold gas being repeatedly passed through a bulk material (4) with a maximum particle diameter ($D_{max}$) which is received in the annular space (1) between a substantially cylindrical hot grid (3) and a cold grid (2) surrounding the latter, and at least one discharge opening (16) being provided in the bottom (B) of the annular space (1) for discharging the bulk material (4), characterized in that a predetermined amount of bulk material (4) is discharged during or after the passing-through of hot gas, so that a compressive stress exerted by the bulk material (4) on the hot grid (3) and cold grid (2) is reduced.

2. Process according to claim 1, the discharged bulk material (4) being fed back into the annular space (1).

3. Process according to claim 2, the discharged bulk material (4) being transported pneumatically.

4. Process according to one of claims 2 or 3, the discharged bulk material (4) being fed to the annular space (1) through a feed opening provided in the vicinity of its top (D).

5. Process according to claim 4, the transporting gas being separated from the bulk material (4) and blown off into the surroundings.

* * * * *

UNITED STATES PATENT AND TRADEMARK OFFICE

CERTIFICATE OF CORRECTION

PATENT NO. : 6,334,265 B1
DATED : January 1, 2002
INVENTOR(S) : Andreas Emmel et al.

It is certified that error appears in the above-identified patent and that said Letters Patent is hereby corrected as shown below:

Title page,
Item [57], ABSTRACT,
Line 5, after "cold grid 4", please insert -- [sic] --.
Last line, after "cold grid 4", please insert -- [sic] --.

Column 4,
Line 6, please delete "passes,into", and insert -- passes into --.

Signed and Sealed this

Third Day of September, 2002

*Attest:*

*Attesting Officer*

JAMES E. ROGAN
*Director of the United States Patent and Trademark Office*